US010037637B1

(12) United States Patent
Yamada

(10) Patent No.: US 10,037,637 B1
(45) Date of Patent: Jul. 31, 2018

(54) SECURITY SYSTEM

(71) Applicant: KYOCERA Document Solutions Inc., Osaka (JP)

(72) Inventor: Atsushi Yamada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/884,101

(22) Filed: Jan. 30, 2018

(30) Foreign Application Priority Data

Jan. 30, 2017 (JP) ..... 2017-014156

(51) Int. Cl.
*G07C 9/00* (2006.01)
*G06Q 50/26* (2012.01)

(52) U.S. Cl.
CPC ..... *G07C 9/00079* (2013.01); *G06Q 50/265* (2013.01)

(58) Field of Classification Search
CPC ..... G07C 9/00079; G06Q 50/265
USPC ..... 340/5.5–5.55
See application file for complete search history.

(56) References Cited

U.S. PATENT DOCUMENTS 5,026,990 A * 6/1991 Marman ..... G08B 13/19 250/342
7,760,091 B2 * 7/2010 Comerford ..... E05B 19/0005 340/568.1
9,568,902 B2 * 2/2017 Dunn ..... G06F 3/016
2006/0212570 A1 9/2006 Aritsuka et al.
2015/0379862 A1 * 12/2015 Jones, Jr. ..... G08B 13/19645 348/153
2017/0220242 A1 * 8/2017 Dunn ..... G06F 3/04883

FOREIGN PATENT DOCUMENTS

JP 2006-127064 A 5/2006
JP 2006-259953 A 9/2006

* cited by examiner

*Primary Examiner* — Allen T Cao
(74) *Attorney, Agent, or Firm* — Hawaii Patent Services; Nathaniel K. Fedde; Kenton N. Fedde

(57) ABSTRACT

To ensure that guest abnormal behavior can be easily found by visual inspection. A security system includes a staff electronic name tag device (SENTD), a guest electronic name tag device (GENTD), a monitoring device, a guest management device, and a gate device. The SENTD displays the face image of the staff who is assigned with the SENTD. The GENTD includes a display unit and a first wireless communication unit. The display unit displays the face image of the guest to which the GENTD is assigned. The photographing unit photographs the face image of the guest in the facility and outside the monitoring area. The second wireless communication unit wirelessly communicates with the first wireless communication unit of the guest electronic tag unit. The holder registration unit transmits the photographed face image of the guest to the GENTD in the second wireless communication unit for display.

4 Claims, 4 Drawing Sheets

SECURITY SYSTEM

INCORPORATION BY REFERENCE

This application is based on and claims the benefit of priority from Japanese Patent Application No. 2017-014156 filed on Jan. 30, 2017 the contents of which are hereby incorporated by reference.

BACKGROUND

The present invention relates to a security system.

In a typical exemplary security system, in a facility where base stations are provided in a distributed manner, when a person moves with a wireless mobile sensor node, the wireless mobile sensor node communicates with its nearest base station. Then, it is detected that the base station communicating with the wireless mobile sensor node switches to another, and the person's behavior is being kept under observation.

On the other hand, in a typical examplary electronic business card system, the electronic business card device downloads the user ID, personal information, and face photograph data corresponding to the ID of the electronic business card device from the server and displays the user ID and the face picture on a display unit. In this system, a visitor has his/her own electronic business card device and personal information etc. of an interviewer who deals with the visitor, upon arrival of the visitor at the interviewer, are to be transmitted to and displayed on the visitor's electronic business card.

SUMMARY

A security system according to the present disclosure includes a staff electronic name tag device, a guest electronic name tag device, a monitoring device, a monitoring device, and a gate device. The staff electronic name tag device is assigned to each staff member in a facility and carried by each staff member in a visible manner for others. The guest electronic name tag device is assigned to each guest in a lent manner and carried by the each guest in a visible state for others. The monitoring device uses a sensor network provided in a monitoring area in the facility to monitor a position of the electronic name tag device of the each staff member in the facility and a position of the guest electronic name tag device. The guest management device assigns a guest to the guest electronic name tag device. The gate device permits the guest electronic name tag device to enter the facility after the guest is assigned and permits the staff electronic name tag device to enter the facility after successful authentication of the staff electronic name tag device. Then, the staff electronic name tag device is configured to display a face image of the each staff who is assigned with the staff electronic name tag device. The guest electronic name tag device is provided with a display unit and a first wires communication unit. The display unit displays a face image of the each guest who is assigned with the guest electronic name tag device. The first wireless communication unit communicates with the guest management in a wireless manner. The guest management device is provided with a photographing device, a second wireless communication unit, and a holder registering unit. The photographing device photographs the face image of the guest in the facility and outside the monitoring area. The second wireless communication unit communicates with, in a wireless manner, the first wireless communication unit of the guest electronic name tag device. The holder registering unit causes the second wireless communication unit to transmit the photographed face image of the each guest to the guest electronic name tag device for display.

DETAILED DESCRIPTION

Embodiments of the present disclosure will be described below with reference to the attached drawings.

Figure 1:
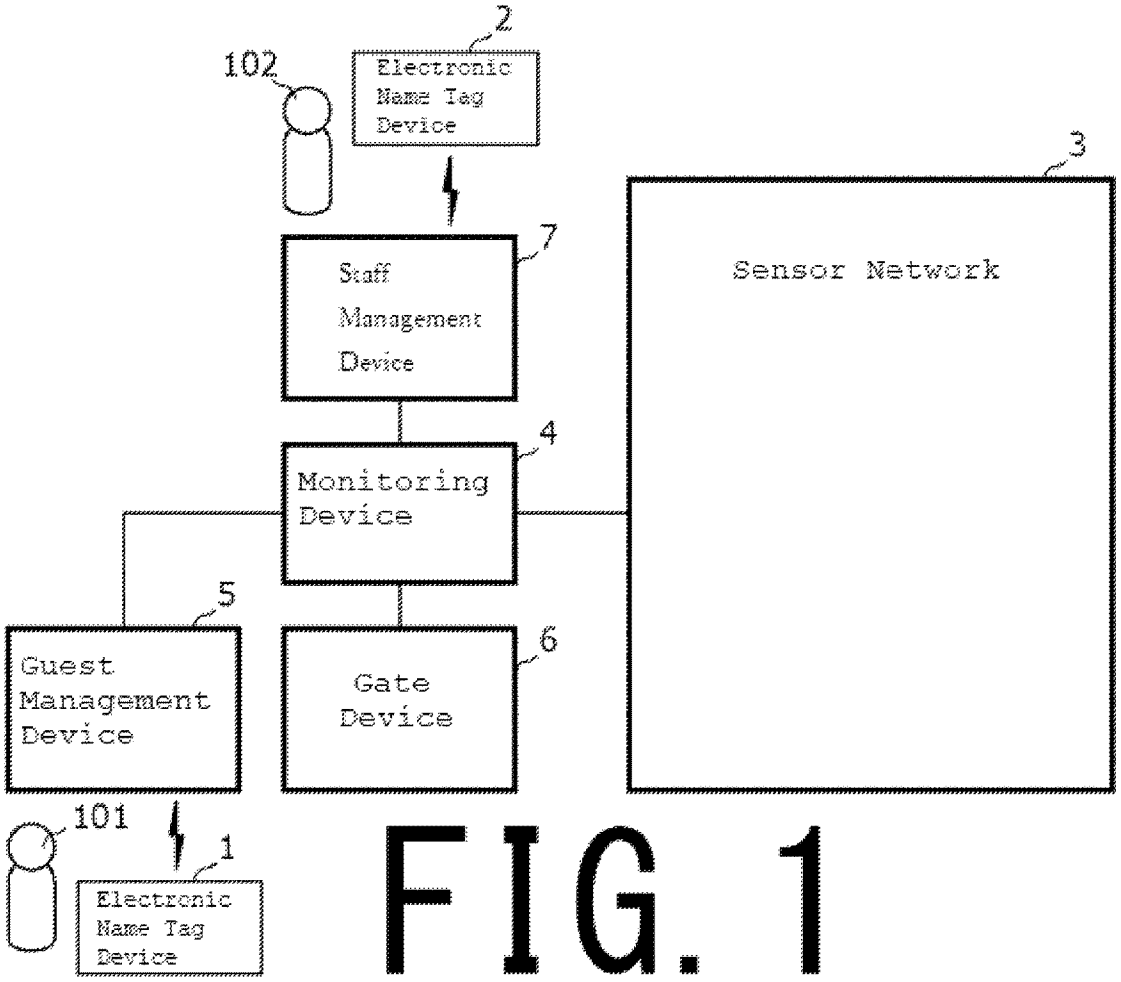
FIG. 1 is a block diagram showing a configuration of a security system according to an embodiment of the present disclosure.

FIG. 1 is a block diagram showing a configuration of a security system according to an embodiment of the present disclosure.

In the security system shown in FIG. 1, an electronic name tag device 1 is a guest electronic name tag device 1 allocated to each guest 101 in a lent manner only while he/she is staying in a facility such as a company. An electronic name tag device 2 is a staff electronic name tag device assigned to each staff member 102 in the facility. It is to be noted that the electronic name tag devices 1 and 2 are portable and are worn by the staff member 102 and each guest 101, respectively, with a strap or clip such that they are visible from, others. The electronic nameplate device 1 displays a face image of the guest to whom the electronic name tag device 1 is assigned. The electronic name tag device 2 displays a face image of the staff member who is assigned with the electronic name tag device 2.

In the facility, there are also installed a sensor network 3, a monitoring device 4, a guest management device 5, a gate device 6, and a staff management device 7.

The sensor network 3 includes sensor nodes arranged in a distributed manner in monitoring areas in the facility. The monitoring area is set inside the gate unit 6. Each of the sensor nodes has a wireless communication interface that is capable of conducting wireless communication with the electronic name tag devices 1 and 2 that exist within a specified distance range. Each of the sensor nodes uses the wireless communication interface to detect the electronic name tag devices 1 and 2 and notifies the monitoring device 4 of the device ID of the electronic name tag devices 1 and 2 and the like.

The monitoring device 4 is coupled to the sensor network 3 in a wired or wireless communication manner and conducts a database management by interconnecting, in a mutual way, the node ID and installation location of each of the sensor nodes of the sensor network 3. Then, the monitoring device 4, using the sensor network 3 that is installed in the monitoring area in the facility, detects the position of the electronic name tag device 1 in the facility (that is, the position of the guest 101) and the position of the electronic name tag device 2 (that is, the position of the staff member 102).

The monitoring device 4 is a terminal device that includes, for example, a communication unit capable of communicating with the guest management device 5, the gate device 6, the staff management device 7 and like, and another communication unit capable of communicating with the sensor network 3 and the like. The monitoring device 4 identifies the position of the sensor node that has detected the electronic name tag device 1 as the position of the electronic name tag device 1 assigned to the guest 101 and if the position is determined to be within an area where an entry of the guest 101 is not permitted, the monitoring device 4, using the sensor network 3, transmits a warning command to the electronic name tag device 11.

The guest management device 5 is a terminal device that assigns the guest 101 to the electronic name tag device 1. The guest management device 5 is installed inside the facility and outside the monitoring area (that is, outside the gate device 6 such as a lobby of a building entrance or the like).

The gate device 6 permits the electronic name tag device 1 (that is, the guest 101) to enter the facility after the guest 101 is allocated with the electronic name tag device 1, and permits the electronic name tag device 2 (that is, the staff 102) to enter the facility after the electronic name tag device 2 succeeds in authentication. It is to be noted that the gate device 6 refuses to enter the person who does not have the electronic name tag device 1 or 2. In addition, in case of failure of an authentication of the electronic name tag device 2, the gate device 6 refuses an entry of the concerned staff member 102.

The staff management device 7 is a terminal device that assigns the electronic name tag device 2 to the staff member 102. It is to be noted that the guest management device 5, when the guest 101 comes, assigns the guest 101 to the electronic name tag device 1, while the staff management device 7 assigns the staff member 102 to the electronic name tag device 2 upon entrance of the staff member 102.

Figure 2:
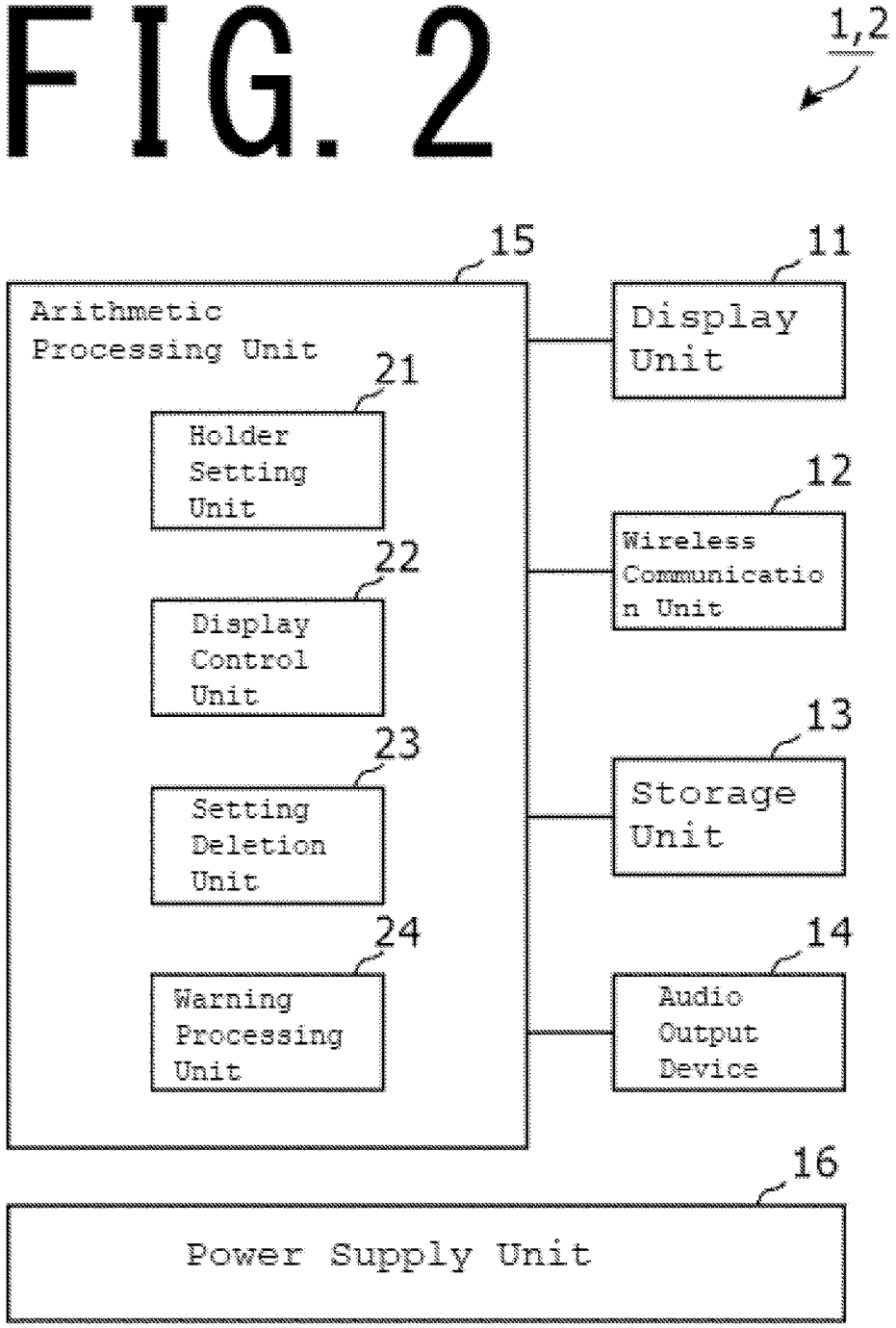
FIG. 2 is a block diagram showing a configuration of an electronic name tag devices 1 and 2 shown in FIG. 1.
Figure 3:
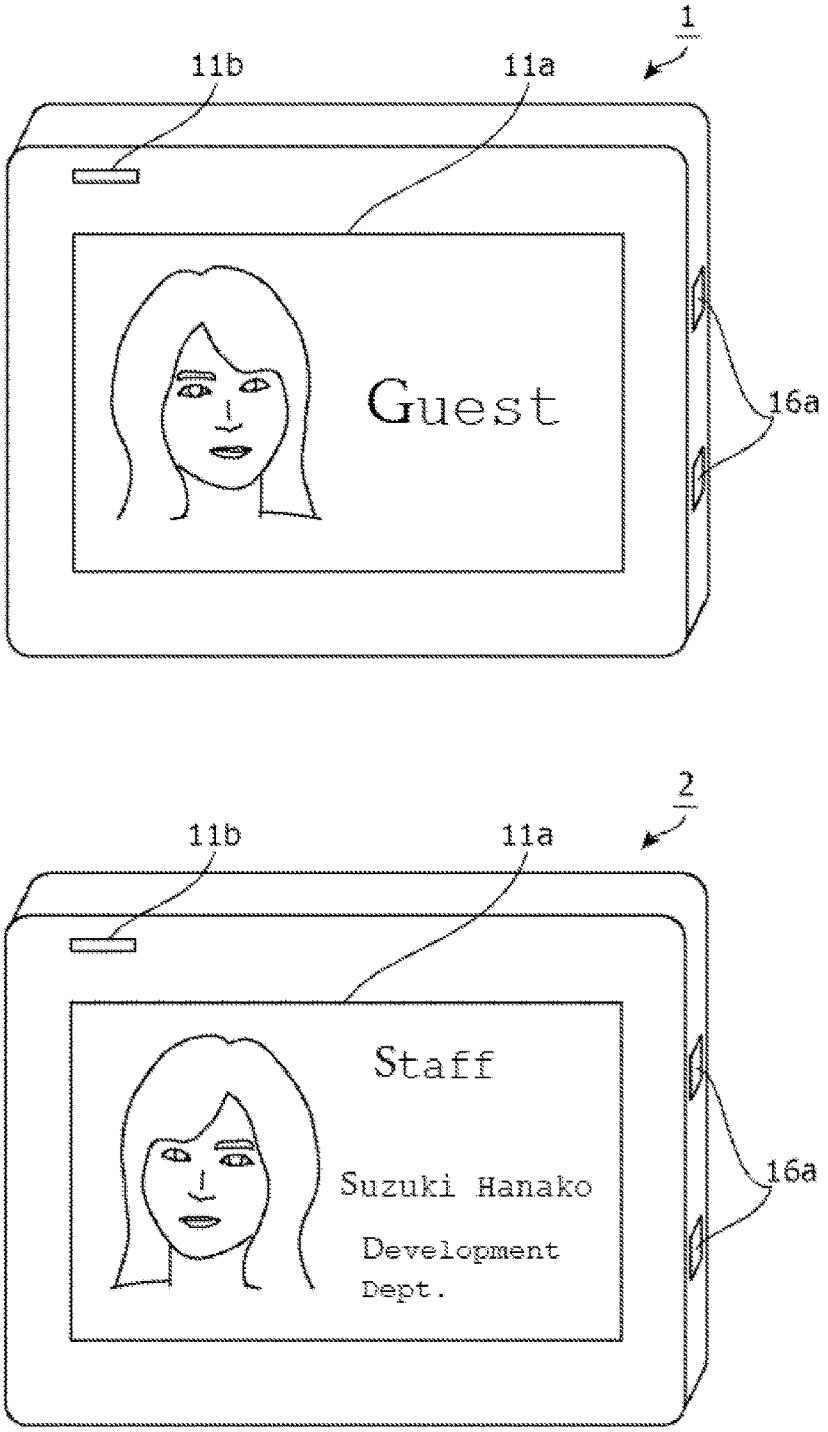
FIG. 3 is a perspective view of the electronic name tag devices 1 and 2 in FIG. 1.

FIG. 2 is a block diagram showing a configuration of the electronic name tag devices 1 and 2 shown in FIG. 1. FIG. 3 is a perspective view of the electronic name tag devices 1 and 2 shown in FIG. 1.

The electronic name tag devices 1 and 2 are common in their hardware as shown in FIG. 2. Each of the electronic name tag devices 1 and 2 includes a display unit 11, a wireless communication unit 12, a storage unit 13, an audio output unit 14, an arithmetic processing unit 15, and a power supply unit 16.

The display unit 11 includes a thin display panel 11*a* such as a liquid crystal display, an organic EL display or the like, an indicator 11*b*, and the like. The display unit 11 causes its thin display panel 11*a* to display the face image of at least a holder (the staff member 102 or the guest 101) of the electronic name tag devices 1 or 2.

The wireless communication unit 12 is a wireless communication unit for short-range wireless communication within a communication coverage range of, for example, several meters to several tens of meters. For example, the wireless communication unit 12 is a wireless interface of Bluetooth (registered trademark) such as BLE.

The wireless communication unit 12 is capable of communicating with the sensor nodes of the sensor network 3, the guest management device 5, the staff management device 7, and the like which are within the communicable range.

The storage unit 13 is in the form of a rewritable memory for storing the image data of the face image of the holder. As the storage unit 13, a volatile memory, a nonvolatile memory, or the like is available in appropriate manner.

The audio output unit 14, using a speaker or the like, outputs operation sounds, warning sounds, and the like.

The arithmetic processing unit 15 includes a computer having a CPU or the like and operates as various processing units by executing a program stored in the storage unit 13 or the storage device. In this configuration, the arithmetic processing unit 15 operates as a holder setting unit 21, the display control unit 22, the setting deleting unit 23, and the warning processing unit 24.

The holder setting unit 21, using the wireless communication unit 12, receives the image data of the face image of the holder (the guest 101 or the staff member 102) together with the holder's attribute information from the guest management device 5 or the staff management device 7 and stores the received image data and attribute information in the storage unit 13. The attribute information includes the type of holder (the staff member or the guest), and a staff ID in the case of staff member, a staff ID, a name, a department name, and the like.

A display control unit 22 causes, based on the image data in the storage unit 13, the thin display panel 11*a* of the display unit 11 to display the face image of the holder as shown in FIG. 3. At this time, if the holder type is guest, the display control unit 22 causes the thin display panel 11*a* to display an image (for example, a text "guest" as shown in FIG. 3) providing a guest indication together with the face image. On the other hand, if the holder type is staff member, the display control unit 22 causes the thin display panel 11*a* to display the staff member's name, department name, etc. based on the attribute information in the storage unit 13 together with the face image.

A setting deletion unit 23, when receiving a face image deletion instruction at the wireless communication unit 12, deletes the image data of the face image in the storage unit 13. It is to be noted that the attribute information is also deleted together with the image data.

A warning processing unit 24 causes, when receiving a warning command from the monitoring device 4 via the wireless communication unit 12, the thin display panel 11*a* of the display unit to display a warning screen. At the same time, the warning processing unit 24 may cause the sound output unit 14 to output an alarm sound.

The power supply unit 16 supplies electric power to the internal devices (such as the display unit 11, the wireless communication unit 12, the storage unit 13, the sound output unit 14, the arithmetic processing unit 15, and the like) of each of the electronic name tag devices 1 and 2. The power supply unit 16 may be in the form of a primary battery or a secondary battery with a charging circuit for charging the secondary battery. The charging circuit charges the secondary battery with externally supplied electric power in a contact manner via a power supply terminal 16*a* as shown in FIG. 3 or in a non-contact manner.

Figure 4:
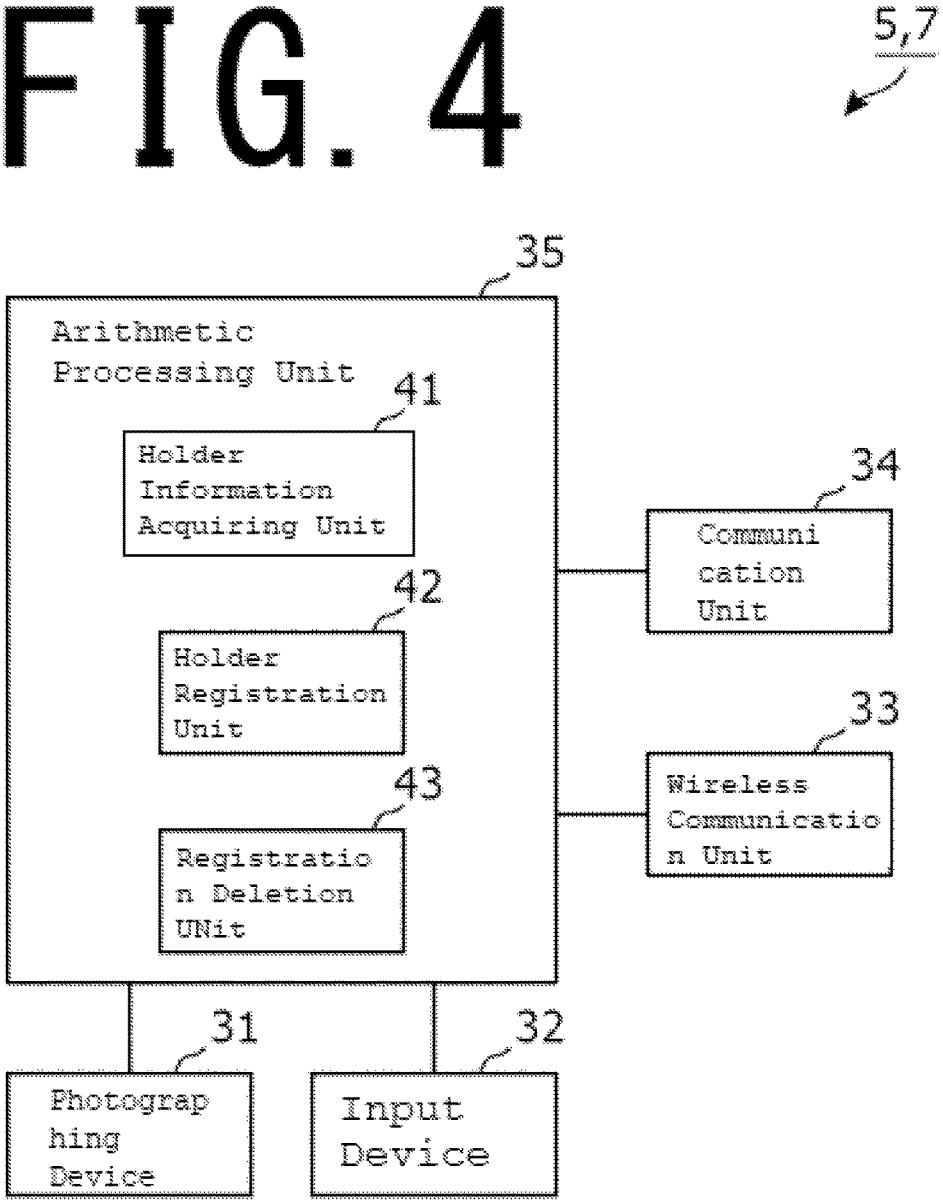
FIG. 4 is a block diagram showing a configuration of each of a guest management device 5 and a staff management device 7 in FIG. 1.

FIG. 4 is a block diagram showing a configuration of each of the guest management device 5 and the staff management device 7 in FIG. 1. The guest management device 5 and the staff management device 7 are provided with common hardware as shown in FIG. 4. More specifically, each of the guest management device 5 and the staff management device 7 includes an photographing unit 31, an input unit 32, a wireless communication unit 33, a communication unit 34, and an arithmetic processing unit 35.

The photographing unit 31 photographs a face image of a holder (the guest 101 or the staff member 102) assigned to the electronic name tag devices 1 or 2.

More specifically, the photographing unit 31 of the guest management device 5 photographs the face image of the guest in the facility and outside the monitoring area (that is, outside the gate device 6).

The input unit 32 is a device such as a keyboard, a hard key, a soft key or the like that accepts a user operation. In the staff management device 7, the input unit 32 is used for input of the attribute information (including, for example, name) of the holder when the holder is a staff member.

The wireless communication unit 33 can communicate with each of the electronic name tag devices 1 and 2 (that is, the wireless communication units 12).

The communication unit 34 is a communication unit that is capable of communicating with the monitoring device 4. For example, when the monitoring device 4, the guest management device 5, and the staff management device 7 are connected to an intranet, the communication unit 34 is treated as a network interface connected to the intranet.

The arithmetic processing unit 35 includes a computer having a CPU or the like and operates as various processing units by executing a program stored in the storage unit. In this configuration, the arithmetic processing unit 35 operates as a holder information acquisition unit 41, a holder registration unit 42, and a registration deletion unit 43.

The holder information acquiring unit 41, which controls the photographing unit 31 according to the operation applied to the input device 32, causes the image capturing unit 31 to capture the face image of the guest 101 or the staff member 102 to transmit the image data of the face image to the holder registration unit 42. The holder information acquisition unit 41 of the staff management device 7 acquires the attribute information of the staff member 102 to be input to the input unit 32 and provides the acquired attribute information to the holder registration unit 42.

The holder registering unit 42 causes the wireless communication unit 33 to transmit the face image (image data of the face image) of the guest 101 or the staff member 102 which is photographed by the photographing unit 31 to the electronic name tag device 1 or 2 for the registration therein together with the display thereon.

In accordance with the operation given to the input unit 32, the registration deletion unit 43 causes the wireless communication unit 33 to transmit a face image deletion command to the electronic name tag devices 1 and 2. When the guest 101 leaves, the registration deletion unit 43 of the guest management device 5 causes the wireless communication unit 33 to transmit the face image deletion instruction to the electronic name tag devices 1 of the guest 101. As a result, pursuant to the face image deletion command, the face image of the guest 101 is deleted from the electronic name tag device 1.

Next, an operation of the above-described security system will be described.

(A) Operation Associated with Staff Member (A1) Registration of Staff Member

First, at the time of an entry of the staff member 102, an administrator or the like operates the staff management device 7 to assign a unique electronic name tag device 2 to the staff member 102 (that is, this electronic name tag device 2 cannot be assigned to another staff member).

In the staff management device 7, according to the operation of the administrator or the like given to the input unit 32, the holder information acquisition unit 41 acquires the image data and the attribute information of the face image of the staff member 102, and the holder registration unit 42 causes the wireless communication unit 33 to transmit the image data and the attribute information to the electronic name tag device 2 of the staff member 102. In the electronic name tag device 2, the holder setting unit 21 causes the wireless communication unit 12 to receive the image data and attribute information and stores the received image data and attribute information in the storage unit 13. The display control unit 22 of the electronic name tag device 2 causes the display unit 11 to display the face image and attribute information of the staff member 102 based on the image data and the attribute information as shown in FIG. 3, for example.

In addition, the holder registration unit 42 of the staff management unit 7 notifies the monitoring device 4 of the staff ID of the staff 102 and the device ID of the electronic name tag device 2 assigned to the staff member 102. The monitoring device 4, when receiving the staff ID and the device ID, registers the received staff ID and device ID in the database in association with each other.

(A2) Staff Member's Entry Through the Gate

If the staff member 102 want to enter the facility, he/she with his/her assigned electronic name tag device 2 comes to the installation location of the gate device 6.

The gate device 6 acquires the device ID and the staff ID of the electronic name tag device 2 in a wireless communication manner from the electronic name tag 2 and determines whether or not the paired device ID and staff ID is registered in the database of the monitoring device 4. If the paired device ID and staff ID is determined to be registered in the database of the monitoring device 4, the gate device 6 permits the staff member 102 to enter the facility, and otherwise refuses an entrance of the staff member 102.

(A3) Monitoring Staff Member

The staff member 102, who has entered the facility, carries the electronic name tag device 2 in visible to others and moves around within the facility.

When a specific one of the sensor nodes detects the electronic name tag device 2, the sensor network 3 notifies the monitoring device 4 of the node ID of the sensor node and the device ID of the electronic name tag device 2. The monitoring device 4, when receiving the node ID and the device ID, identifies the installation location of a sensor node having the node ID and determines that the electronic name tag device 2 having the received device ID (that is, the staff member to whom the electronic name tag device 2 is assigned) exists in the location. Thereby, the monitoring device 4 can grasp the position of the staff member 102 entering the facility (that is, within the monitoring area).

(B) Guest Associated Operation (B1) Registration of Guest

When a guest 101 visits the facility, first, at the reception, a confirmation is made as to an identification of the guest 101 and if the guest 101 is permitted to enter the facility, the electronic name tag device 1 (that is not one assigned to another guest) is assigned to the guest 101.

In the guest management device 5, according to the operation of the receptionist or the like, the holder information acquisition unit 41 acquires the image data of the face image of the guest 101 from the photographing device 31, and the holder registration unit 42 causes the wireless communication unit 33 to transmit the image data and attribute information indicating that the holder is "guest" to the electronic name tag device 1 of the guest 101. In the electronic name tag device 1, the holder setting units 21 causes the wireless communication unit 12 to receive the image data and the attribution information and stores the received image data and attribution information in the storage unit 13. Based on these image data and attribution information, the display control unit 22 of the electronic name tag device 1 causes the display unit 11 to display, as shown in FIG. 3, the face image of the guest 101 and an image indicating that the holder is "guest".

In addition, the holder registration unit 42 of the guest management device 5 notifies the monitoring device 4 of the device ID of the electronic name tag device 1 assigned to the guest 101. The monitoring device 4, when receiving the device ID, registers the device ID in the database as the electronic name tag device 1 assigned to the guest.

It is to be noted that in this embodiment, personal information of the guest 101 is unnecessary for the registration of the guest 101, but like the staff member 102, the personal information of the guest 101 may be registered as part of the attribute information.

Thereafter, the electronic name tag device 1 is lent to the guest 101. At this point, the face image of the guest 101 is being displayed on the electronic name tag device 1.

(B2) Guest's Passage Through the Gate

The guest 101 comes to the installation location of the gate device 6 in order to enter the facility after being lent with the electronic name tag device 1 that displays his/her own face image at the reception.

The gate device 6 conducts communication with the electronic name tag device 1 to acquire the device ID of the electronic name tag device 1 and determines whether or not the acquired device ID is registered as being assigned to the guest in the database of the monitoring device 4. If the device ID is determined to be thus registered in the database of the monitoring device 4, the gate device 6 permits an entry of the guest 101, and otherwise rejects an entry of the guest 101.

(B3) Monitoring the Guest

The guest, who has entered the facility, carries the electronic name tag device 1 in visible to others and moves within the facility.

If a specific one of the sensor nodes detects the electronic name tag device 1, the sensor network 3 notifies the monitoring device 4 of the node ID of such a sensor node and the device ID of the electronic name tag device 1. The monitoring device 4, when receiving the node ID and the device ID, identifies the installation location of the sensor node having the node ID, and determines that the electronic name tag device 1 (that is, any guest 101) having the device ID exists. Thereby, the monitoring device 4 can grasp the position of the guest 101 who entered the facility (that is, the guest 101 within the monitoring area).

Then, if the guest 101 enters a restricted area (where no guest is permitted to enter), the guest entered such an area is detected by the monitoring device 4 as described above, and based on the instruction from the monitoring device 4, the electronic name tag device 1 of the guest 101 is caused to display a warning screen or sound an alarm. As a result, it is possible to confirm that the guest 101 and another person have entered the restricted area. For this reason, even if the guest 101 intends to enter the restricted area with malice, such an action can be found in an easy way by another person.

If the guest 101 illegally obtains an electronic name tag device 2 of a staff member 102 in the facility and pretends to be the staff member 102, the guest 101 will carry the electronic name tag device 2 displaying the face image of the staff member 102 in visible for others. Therefore, the face image of the guest 101 differs from the face image displayed on the electronic name tag device 2, which makes it possible for others to recognizes the pretention in a visible easy way. Further, in such a way, an easy detection of abnormal behavior in a visible way will also give a restriction thereof.

It is to be noted that in a case where the guest 101 pretends to be the staff member 102 for the intension of entering the restricted area, if the guest 101 keeps carrying the electronic name tag device 1 assigned to him/her, as described above, the electronic name tag device 1 will be detected by the sensor network 3. Therefore, it is necessary for the guest 101 to conceal the electronic name tag device 1 assigned to hide him/her somewhere in the facility. It is to be noted that the necessity to return the electronic name tag device 1 at the time of leaving disables the discarding thereof. More specifically, it is impossible for the guest 101 to attain a compatibility between occupying the electronic name tag device 2 assigned to himself/herself in a conceal manner and carrying the electronic name tag device 2 of the staff member 102 in visible. In addition, if the hidden electronic name tag device 1 is found, the displayed face image of the guest 101 thereon will cause an immediate identification of the guest 101 under abnormal behavior. Further, even if the guest 101 does not carry any of the electronic name tag devices 1 and 2 in visually observable, another person can find the guest 101 as a suspicious person at a glance.

In this way, these abnormal behaviors of the guest 101 are easily detected and suppressed.

(B4) Registration Deletion of the Guest

The guest 101, at the time of leaving, returns the lent electronic name tag device 1 to the reception. Then, the person who is in charge of reception or the like deletes the registration of the guest 101 associated with the electronic name tag device 1.

In the guest management device 5, according to the operation of the receptionist or the like, the registration deletion unit 43 causes the wireless communication unit 33 to transmit the face image deletion command to the electronic name tag device 1. In the electronic name tag device 1, the setting deletion unit 23 deletes the image data (and attribute information) of the face image stored in the storage unit 13.

In addition, the registration deletion unit 43 of the guest management device 5 notifies the monitoring device 4 of the device ID of the electronic name tag device 1. The monitoring device 4, when receiving the device ID, deletes the device ID as the electronic name tag device 1 assigned to the guest in the database.

As a result, the electronic name tag device 1 returns to the state before being lent to the guest 101.

As described above, according to the above embodiment, the electronic name tag device 2 is assigned to each the staff member 102 in the facility, while the electronic name tag device 1 is allocated in a lent manner to each the guest 101. The monitoring device 4 uses the sensor network 3 installed in the monitoring area in the facility to monitor the positions of the electronic name tag devices 1 and 2 in the facility. The gate device 6 permits the electronic name tag device 1 (that is, the guest 101) to enter the facility after the guest 101 is allocated with the electronic name tag device 1, and permits the electronic name tag device 2 (that is, the staff 102) to enter the facility after the electronic name tag device 2 succeeds in authentication. Then, the electronic name tag device 1 displays the face image of the guest 101 who is assigned with the electronic name tag device 1, while the electronic name tag device 2 displays the face image of the staff member 102 to whom the electronic name tag device 2 is assigned. The guest management device 5 photographs the face image of the guest 101 in the facility and outside the monitoring area with the photographing unit 31 and transmits, in a wireless manner, the photographed face image of the guest 101 to the electronic name tag device 1 for display.

As a result, abnormal behavior of the guest 101 within the monitoring area can be easily found in visible.

In the security system of the above-described typical example, even when a malicious guest moves without carrying his/her wireless mobile sensor node, it is difficult for the staff member or the like to easily discover the behavior of the guest. Also, with the above-described security system, if a malicious guest illegally obtains the wireless mobile sensor node of the staff member, he/she can impersonate as a staff member and it is difficult for the true staff member or the like to easily discover the behavior of the guest.

Further, although it may be possible to use an electronic business card of the above-mentioned typical example, visitors (that is, guests) need to prepare their own electronic business cards, which is not realistic. In such a case, a malicious guest can switch the face image displayed on the electronic business card machine in advance to his/her own face image and staff member's face image, which makes it possible for the malicious guest to easily impersonate a staff member after entering the facility.

However, according to the security system of the present disclosure, an abnormal behavior of a guest can be easily found by visual inspection.

Various changes and modifications to the above-described embodiment will be apparent to those skilled in the art. Such changes and modifications may be made without departing from the spirit and scope of the subject matter and without diminishing its intended advantages. That is, such changes and modifications are intended to be included within the scope of the appended claims.

For example, in the above-described embodiment, the electronic name tag devices 1 and 2 may be configured without including input devices (hardware keys or the like) for accepting respective operations from the guest 101 and the staff member 102. As a result, it is possible to prevent illegal operations conducted from the guest 101 to the respective electronic name tag device 1 and 2.

In addition, in the above-described embodiment, the power supply unit 16 of each of the electronic name tag device 1 and 2 may be configured such that as a power management mode either one of standby and operation modes is selectable. In the standby mode, the display unit 11 is extinguished, and the electronic name tag devices 1 and 2 are set to be in a power-saving operation. In the operation mode, the display unit 11 is lit. For example, the power supply unit 16 of each of the electronic name tag device 1 and 2 may be configured to receive a mode selection command from an external unit via the wireless communication unit 12 and select, as the power management mode, either one of standby mode and the operation mode according to the mode selection command. In addition, the electronic name tag device 1 of the guest 101 may be configured such that when the face image of the guest 101 is registered in the electronic name tag device 1 (that is, when the face image of the guest 101 is stored in the storage unit 13), the power management mode is automatically switched to the operation mode, and when the face image of the guest 101 is deleted from the electronic name tag device 1 (that is, when the image data of the face image of the guest 101 is deleted in the storage device 13), the power management mode is automatically switched to the standby mode. Further, the power supply unit 16 of the electronic name tag device 2 of the staff member 102 may automatically select the standby mode outside the facility, while automatically selecting the operation mode when entering the facility. In such a case, for example, a beacon or the like of a wireless communication scheme similar to that of the sensor node of the sensor network 3 is installed in the area inside the facility and concurrently outside the monitoring area, and the power supply unit 16 of the electronic name tag device 2 uses the wireless communication unit 12 to detect that the guest has entered the facility based on wireless communication with the sensor node and the beacon.

The present disclosure is applicable to, for example, a security system using a sensor network in a corporate facility.

What is claimed is:

1. A security system, comprising:

a staff electronic name tag device assigned to each staff member in a facility and carried by the each staff member so as to be visible from others;

a guest electronic name tag device assigned to each guest in a lent manner and carried by the each guest so as to be visible from others;

a monitoring device using a sensor network provided in a monitoring area in the facility to monitor a position of the staff electronic name tag device in the facility and a position of the guest electronic name tag device;

a guest management device assigning the each guest to the guest electronic name tag device in the facility; and a gate device permitting the guest electronic name tag device to enter the facility after the guest is assigned and permitting the staff electronic name tag device to enter the facility after successful authentication of the staff electronic name tag device, the staff electronic name tag device being configured to display a face image of the each staff who is assigned with the staff electronic name tag device, the guest electronic name tag device being provided with a display unit displaying a face image of the each guest who is assigned with the guest electronic name tag device and a first wireless communication unit communicating with the guest management device in a wireless manner, the guest management device being provided with a photographing unit that photographs the face image of the each guest in the facility and outside the monitoring area, a second wireless communication unit that communicates with, in a wireless manner, the first wireless communication unit of the guest electronic name tag device, and a holder registration unit causing the second wireless communication unit to transmit the photographed face image of the each guest to the guest electronic name tag device for display.

2. The security system according to claim 1, wherein if the guest electronic name tag device is determined to be in an area where an entry of the guest is not permitted, the monitoring device transmits a warning command to the guest electronic name tag device using the sensor network, and the guest electronic name tag device causes the display unit to display a warning screen when receiving the warning command via the first wireless communication unit.

3. The security system according to claim 1, wherein when the guest leaves, the guest management device causes the second wireless communication unit to transmit a face image deletion command to the guest electronic name tag device for deleting the face image of the guest.

4. The security system according to claim 1, wherein the staff electronic name tag device and the guest electronic name tag device lack any input units that accept staff's operation and the guest's operation, respectively.

* * * * *